United States Patent [19]

Tanner

[11] Patent Number: 4,637,444

[45] Date of Patent: Jan. 20, 1987

[54] WINDOW PROTECTION

[76] Inventor: Paul W. Tanner, Rte. 3, Box 1608, Keystone Heights, Fla. 32656

[21] Appl. No.: 671,112

[22] Filed: Nov. 13, 1984

[51] Int. Cl.[4] ..... E06B 3/32

[52] U.S. Cl. ..... 160/91; 49/61; 49/501

[58] Field of Search ..... 49/61, 50, 62, 501; 160/87, 90, 91; 52/203, 202

[56] References Cited

U.S. PATENT DOCUMENTS

| | | | |
|---|---|---|---|
| 641,324 | 1/1900 | Read | 49/62 |
| 1,940,055 | 12/1933 | Jorss | 49/61 X |
| 1,999,504 | 4/1935 | Jaeger | 49/62 |
| 2,221,005 | 11/1940 | Reese | 49/61 X |
| 2,316,442 | 4/1943 | Lootens | 49/62 |
| 2,581,666 | 1/1952 | Johnson | 49/62 |
| 2,645,826 | 7/1953 | Roos | 49/62 X |
| 2,679,665 | 6/1954 | Beard | 49/61 X |
| 3,738,061 | 6/1973 | Catalano | 49/50 |

*Primary Examiner*—Philip C. Kannan
*Attorney, Agent, or Firm*—Arthur G. Yeager

[57] ABSTRACT

A window unit comprising a frame and at least one window member slideable vertically in the frame, each window member having a window pane covered on the outside by a sheet of expanded metal spaced apart from the window pane.

11 Claims, 9 Drawing Figures

WINDOW PROTECTION

BACKGROUND OF THE INVENTION

Windows are capable of being broken by all types of flying objects, intentionally or unintentionally propelled against the window pane. In areas where vagrancy and crime are commonly experienced, windows are frequently the targets of the law breaker. Windows are one of the easier means of access to a house by a burglar. If the window lock is not easily unlocked, the window pane can be broken and the window unlocked. Screens which are employed principally as an insect barrier offer little resistance to the burglar who either removes the screen or cuts through it. Permanent protection can be obtained by installing bars across the window frame, but these are dangerous in that they also prevent the occupant from going out of a window, such as might be necessary in case of a fire. Thus, there is a need for a protective cover over a window to prevent unauthorized entrance or breakage by flying objects and yet to provide a full opening of the window when needed.

It is an object of this invention to provide a novel protective cover for a window pane. It is another object of this invention to provide a protective cover for window panes which slide in the window frame. Still other objects will appear from the more detailed description which follows.

BRIEF DESCRIPTION OF THE INVENTION

This invention relates to a window unit comprising a window frame in which is mounted a window member having its window pane covered on its outside surface with a sheet of expanded metal spaced apart from the pane by a resilient spacer around the perimeter of the pane, said expanded metal sheet being fastened to the window member.

In specific embodiments the window unit may have one or two vertically slideable window members, and in each instance each window member has its own protective cover which slides with the window pane it protects.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
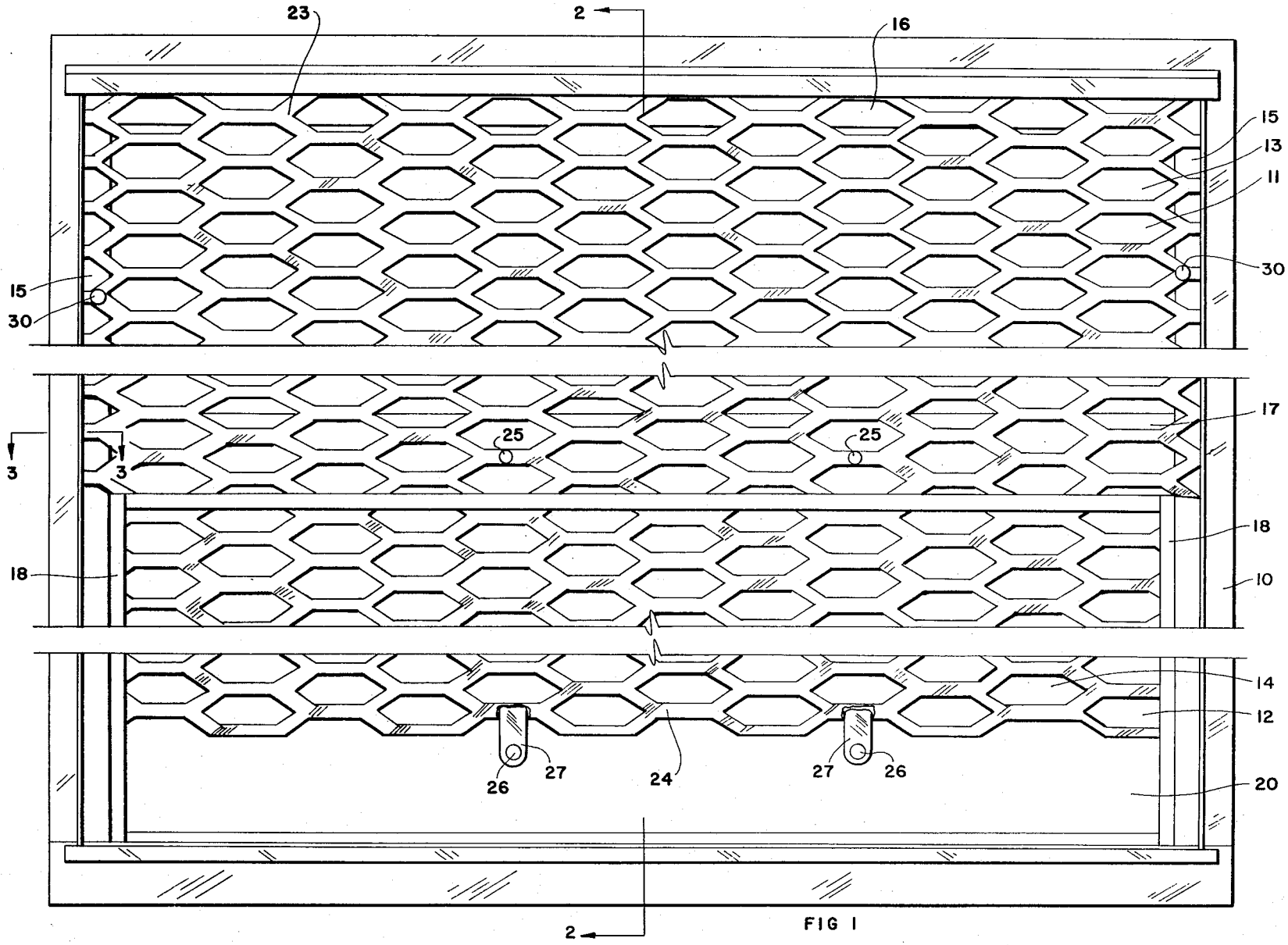
FIG. 1 is a top plan view of a window unit protected in accordance with this invention.
Figure 2:
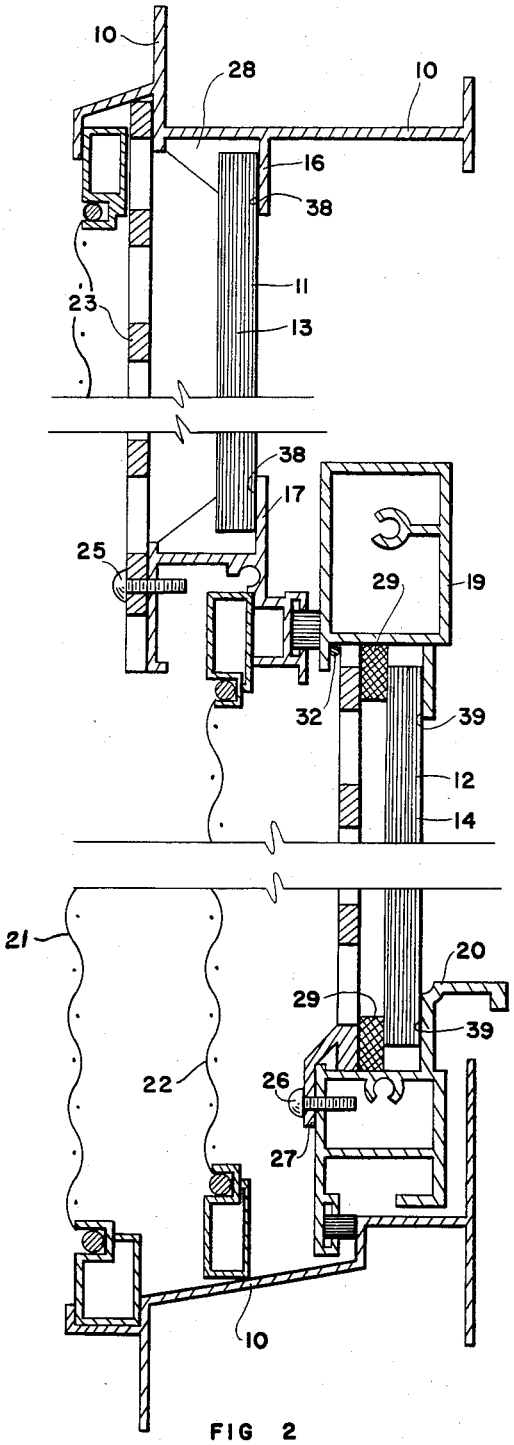
FIG. 2 is a cross sectional view taken at 2—2 of FIG. 1.
Figure 3:
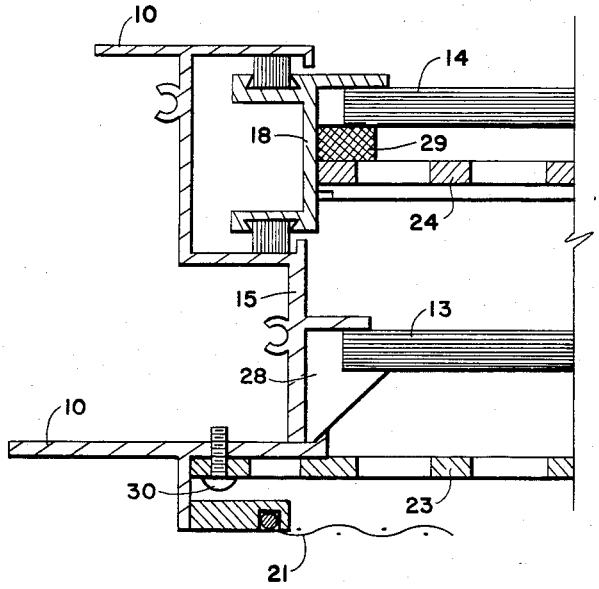
FIG. 3 is a cross sectional view taken at 3—3 of FIG. 1.

In FIGS. 1–3 there are shown the various features of a window unit embodying the present invention. A window frame 10 is adapted to be set into an opening in a wall of a house and affixed thereto. The frame 10 may have features for a single hung window (wherein one window pane slides vertically up and down) or it may have features for a double hung window (wherein two window panes slide vertically up and down). The version shown here is a single hung window with two window panes, the upper being fixed and the lower being vertically slideable. Window frame 10 shown in these drawings is made of a metal, such as aluminum, although this invention is equally operable with a wooden frame.

Upper window member 11 comprises window pane 13 attached by an appropriate film of glue or cement 38 to a supporting frame of two vertical side supports 15, upper horizontal support 16 and lower horizontal support 17. It is common practice to mount the window pane 13 in a glazing 28 which fits in a recess in the supporting frame by a snap fit. In order to protect window pane 11, a sheet 23 of expanded metal is attached to supporting frame members 15, 16, and 17 by screws 25 and 30. Since pane 11 is fixed, sheet 23 may be attached to frame 10 if desired. The method of attachment is not a critical feature of the invention, screws, rivets, welding, or the like are suitable. If an insect screen 21 is a feature of the window unit, sheet 23 is mounted between the screen 21 and the window pane 11 so the screen may be installed or removed without moving sheet 23. It is important to space sheet 23 away from window pane 11 sufficiently to provide for flexibility of the expanded metal sheet 23 and yet keep the two from actual contact during flexure of sheet 23.

Lower window member 12 is intended to illustrate the features of a slideable window pane. In the case of a double hung window unit both window panes would have the features about to be described with respect to window member 12. In this instance the snap-in glazing (28 on window member 11) is not employed because there is no way to employ the expanded metal sheet 24 if such a glazing is included. In place of the standard glazing there is employed a resilient elastomeric glazing 29 in the form of a gasket around the outer perimeter of pane 14 on the outer surface thereof. This leaves room for a sheet 24 of expanded metal to be inserted in the recesses in supports 18, 19, 20 that make up the supporting frame for window pane 14. Window pane 14 is also cemented or glued to supports 18, 19 and 20 at 39 in the same manner as described above with respect to upper window panels. Resilient glazing 29 forms an excellent seating for sheet 24, and keeps it spaced apart from the outside surface of pane 14 as needed to prevent breakage when sheet 24 is flexed. Sheet 24 is fastened in any convenient place and manner to the vertical supports 18, the upper horizontal support 19, or the lower horizontal support 20 of the lower window member 12. A preferred location is the lower horizontal support 20. This may be accomplished by welding tabs 27 to sheet 24 and fastening the tabs 27 to support 20 by screws 26. Other fastening means, such as rivets, welding, and the like, are also acceptable. If sheet 24 does not fit tightly enough in supports 18 and 19 a sealing strip 32 may be pressed into or snapped into the spacing between sheet 24 and the lip around supports 18 and 19 used to seat snap-in glazing 28. A screen 22 for slideable window member 12 is typically employed in such a window unit to cover the opening when window member 12 is slid upwards.

Figure 4:
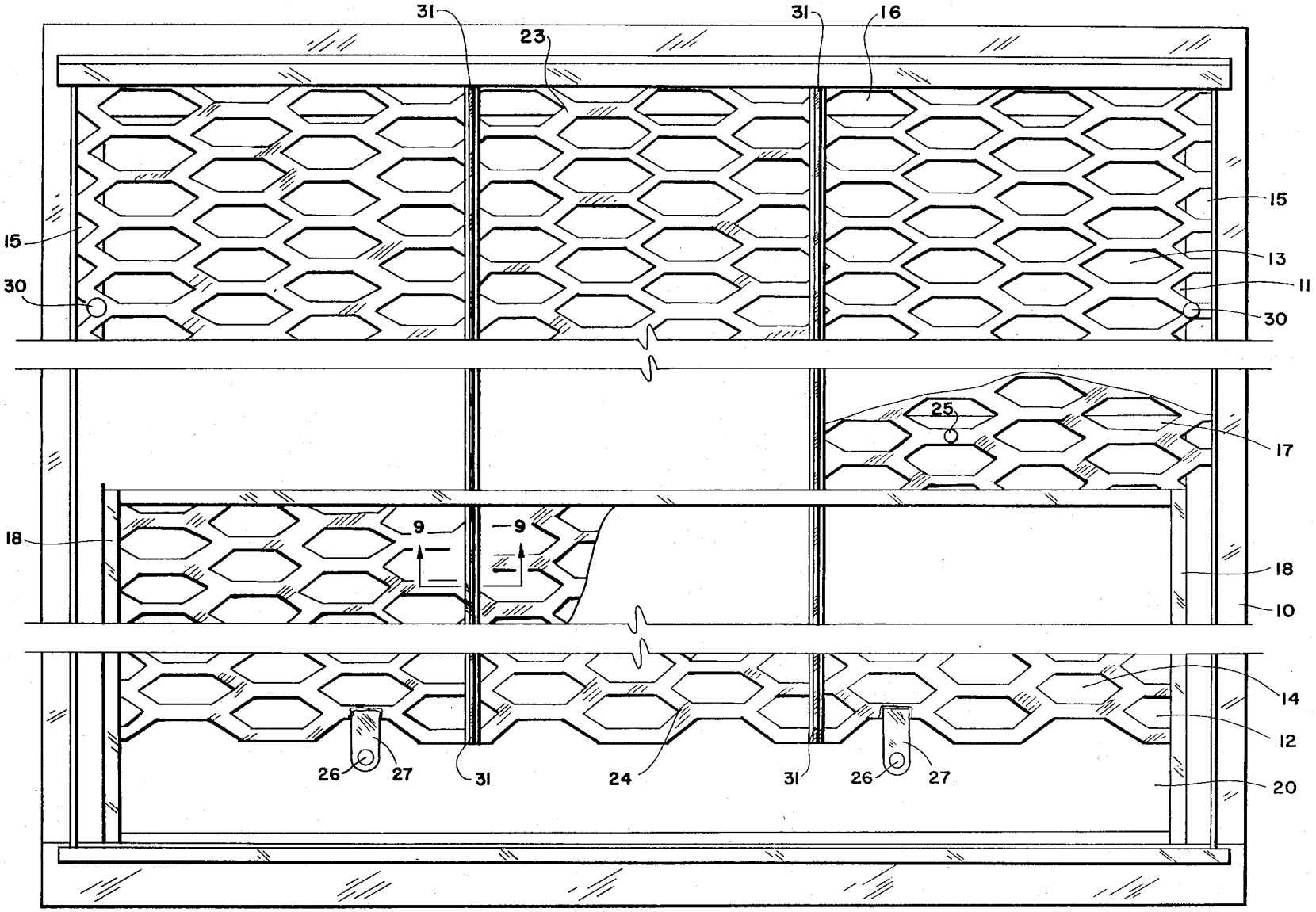
FIG. 4 is a top plan view of a window unit protected in accordance with a special embodiment of this invention.
Figure 9:
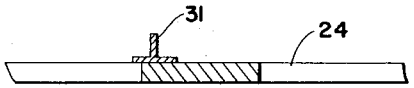
FIG. 9 is a cross sectional view taken at 9—9 of FIG. 4.

It may be desirable in some instances, e.g., for window panes of large area, to employ a means to stiffen sheets 23 and 24 against too much flexure. The most desirable arrangement is for sheet 23 or 24 never to contact panes 13, and 14, respectively, under whatever flexure sheets 23 and 24 may encounter. To minimize that flexure, stiffening members 31 may be employed as shown on FIGS. 4 and 9. Stiffening members may be any construction material that has a low bending possibility, such as T-beam, I-beam, angle beam, or any other shape having a web which will be perpendicular to the surface of sheet 23 or 24. The stiffener is preferably welded to the surface of sheet 23 or 24 to extend from one side to the other. Rods 31 are shown positioned vertically in FIG. 4 but they will provide substantially the same effect if positioned horizontally or diagonally. This feature is particularly desirable where the principal purpose of the expanded metal sheet is to prevent breakage by vagrants throwing rocks or other objects to intentionally break the window.

Figure 5:
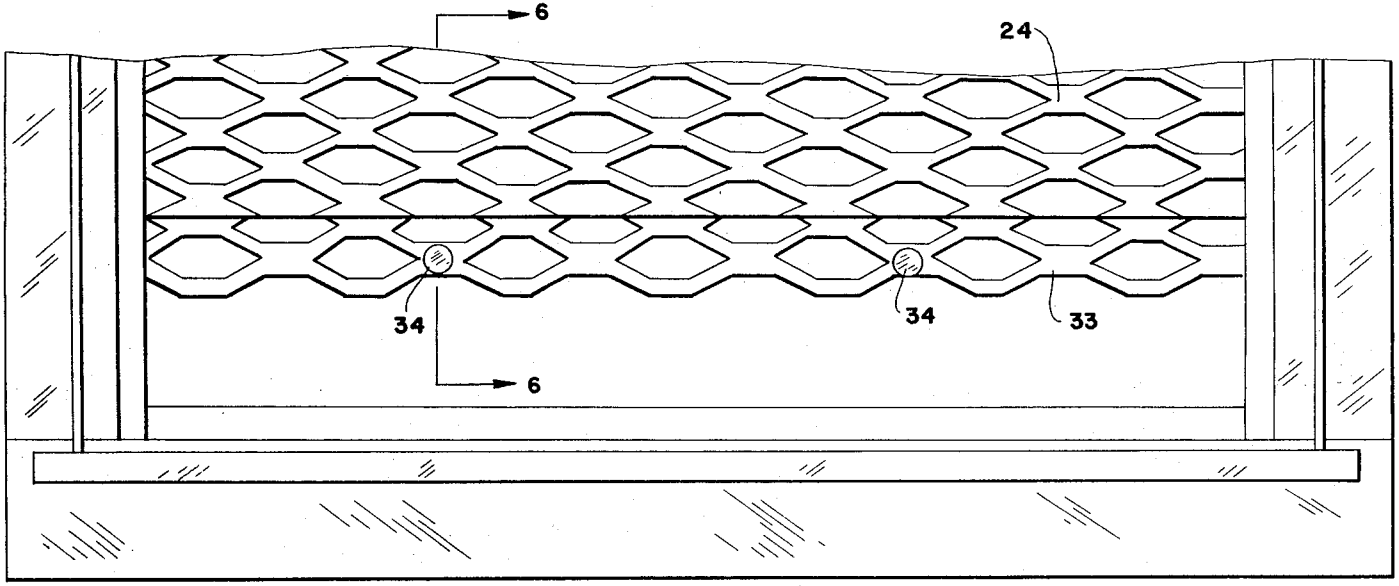
FIG. 5 is a top plan view of a second embodiment of the window of this invention.
Figure 6:
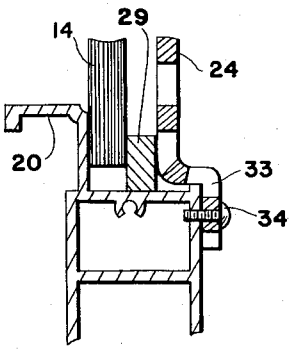
FIG. 6 is a cross sectional view taken at 6—6 of FIG. 5.

In FIGS. 5 and 6 there is shown a second alternative embodiment for fastening sheet 24 to lower horizontal support 20. Sheet 24 is merely extended as at 33 and bent to fit around the outside upper corner of support 20. Extension 33 is fastened directly to support 20 by fasteners 34 which may be screws, rivets, or the like.

Figure 7:
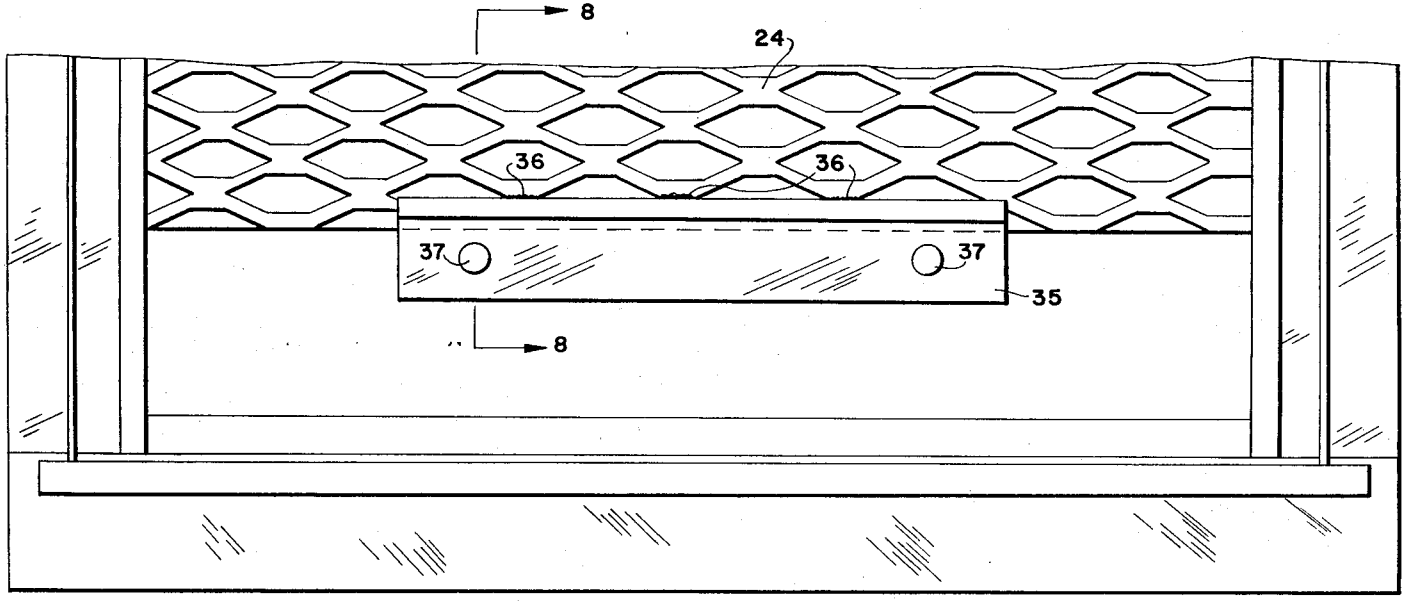
FIG. 7 is a top plan view of a third embodiment of the window of this invention.
Figure 8:
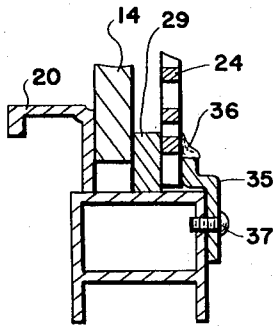
FIG. 8 is a cross sectional view taken at 8—8 of FIG. 7.

In FIGS. 7 and 8 there is shown a third alternative embodiment of the invention in which connector strip 35 is welded or otherwise fastened to sheet 24 at 36. Strip 35 is bent to fit around the upper outer corner of support 20 and is attached to support 20 by fasteners 37, which may be screws, rivets, or the like.

Expanded metal sheets are well known and are made of steel, aluminum, brass, copper, or any other metal. The sheet may have rough edges from the punching and stretching operations involved in manufacturing expanded metal, or those rough edges may be removed. In instances where one wishes to discourage burglars from attempting to remove expanded metal protective sheets from windows, it can be an advantage to employ the ragged edge material that would scratch and cut the fingers of anyone tampering with it, and to employ steel to provide the maximum in strength and inherent stiffness.

While the invention has been described with respect to certain specific embodiments, it will be appreciated that many modifications nad changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A window unit comprising a window frame, at least a lower window member vertically slideably disposed in said window frame;

said window member including a framework formed by two vertical supports, an upper horizontal support and a lower horizontal support with a pane of window glass within said framework;

a sheet of expanded metal spaced apart from said pane and covering the outside surface of said pane, said sheet having outer edges within said framework upper horizontal support and vertical supports;

a resilient spacer located substantially about the perimeter of said pane and sandwiched between said pane and said sheet; and connecting means to rigidly fasten said sheet along its lower edge portion to said lower horizontal support of said window framework.

2. The window of claim 1 wherein said expanded metal sheet includes a plurality of spaced tabs extending downwardly from its lower edge, said connecting means rigidly fastening said tabs to said lower horizontal portion of said window framework.

3. The window of claim 1 further comprising a stiffening member fastened to the outside surface of said expanded metal sheet.

4. The window unit of claim 1 further comprising a connector strip attached to and along said lower edge of said lower horizontal support said connecting means rigidly fastening said connector strip to said lower horizontal support of said window member.

5. The window unit of claim 1 which includes an upper stationary window member above said vertically slideable lower window member, another sheet of expanded metal affixed to and in spaced relationship to said upper window member in spaced relationship outwardly of the window pane thereof.

6. The window unit of claim 5 further comprising a screen member spaced apart from the outside of each said sheet of expanded metal.

7. A window unit comprising an aluminum window frame and two rectangular window members mounted therein and at least the lower of which is vertically slideable therein, each of said window members comprising a rectangular supporting framework formed from two vertical side supports, an upper horizontal and a lower horizontal support, a rectangular window pane mounted in said supports, each of said window panes having an outside surface, a sheet of expanded metal spaced apart from said outside surface of each said window pane, a resilient spacer located within said lower window framework sandwiched between said sheet of expanded metal and said window pane, and connecting means affixing said sheet to said lower horizontal support of said lower window framework.

8. The window unit of claim 7 wherein said resilient spacer extends around the perimeter of said window pane.

9. The window unit of claim 7 further comprising a connector strip affixed to the lower edge of said sheet attached to said lower window member, said connecting means affixing said strip to said lower horizontal support of said lower window framework.

10. The window unit of claim 7 wherein said sheet of expanded metal has jagged edges around the open portions of the expanded metal with such jagged edges being within said framework of said lower window member.

11. The window unit of claim 7 further comprising a stiffening member attached to the outside surface of each said sheet of expanded metal.

* * * * *